US008628178B2

(12) United States Patent
Shiono

(10) Patent No.: US 8,628,178 B2
(45) Date of Patent: Jan. 14, 2014

(54) LIQUID DROPLET DISCHARGE DEVICE

(75) Inventor: Shohei Shiono, Matsumoto (JP)

(73) Assignee: Seiko Epson Corporation (JP)

( * ) Notice: Subject to any disclaimer, the term of this patent is extended or adjusted under 35 U.S.C. 154(b) by 180 days.

(21) Appl. No.: 13/182,454

(22) Filed: Jul. 14, 2011

(65) Prior Publication Data

US 2012/0033004 A1 Feb. 9, 2012

(30) Foreign Application Priority Data

Aug. 5, 2010 (JP) ..... 2010-176371

(51) Int. Cl.
*B41J 2/175* (2006.01)

(52) U.S. Cl.
USPC ..... 347/85

(58) Field of Classification Search
None
See application file for complete search history.

(56) References Cited

U.S. PATENT DOCUMENTS

2007/0115333 A1* 5/2007 Aruga et al. ..... 347/85
2007/0263048 A1* 11/2007 Okito et al. ..... 347/85

FOREIGN PATENT DOCUMENTS

JP 2002-225255 A 8/2002
JP 2003-165231 A 6/2003
JP 2006-272648 A 10/2006
JP 2010-89477 A 4/2010
JP 2010-131976 A 6/2010
JP 2010131976 A * 6/2010
JP 2010-158868 A 7/2010
JP 2010-184424 A 8/2010
JP 2011-005717 A 1/2011

OTHER PUBLICATIONS

Patent English Abstract and Machine English Translation of JP2002-225255A Published Aug. 14, 2002.
Patent English Abstract and Machine English Translation of JP2003-165231A Published Jun. 10, 2003.
Patent English Abstract and Machine English Translation of JP2006-272648A Published Oct. 12, 2006.
Patent English Abstract and Machine English Translation of JP2010-131976A Published Apr. 22, 2010.
Patent English Abstract and Machine English Translation of JP2010-158868A Published Jun. 17, 2010.
Patent English Abstract and Machine English Translation of JP2010-184424A Published Jul. 22, 2010.
Patent English Abstract and Machine English Translation of JP2010-89477 A Published Aug. 26, 2010.
Patent English Abstract and Machine English Translation of JP2011-005717A Published Jan. 13, 2011.

* cited by examiner

*Primary Examiner* — Stephen Meier
*Assistant Examiner* — Tracey McMillion
(74) *Attorney, Agent, or Firm* — Harness, Dickey & Pierce, P.L.C.

(57) ABSTRACT

The liquid droplet discharge device according to this invention has a storage portion which stores liquid, a first supply pipe which is connected to the storage portion and to which the liquid is supplied from the storage portion, a container which is connected to the first supply pipe and to which the liquid is supplied from the first supply pipe, a head which discharges the liquid supplied from the container, and a stirring member which stirs the liquid in the container, in which the capacity of the container is equal to or larger than the capacity of the first supply pipe.

5 Claims, 6 Drawing Sheets

LIQUID DROPLET DISCHARGE DEVICE

Priority is claimed under 35 U.S.C. §119 to Japanese Application No. 2010-176371 filed on Aug. 5, 2010, which is hereby incorporated by reference in its entirety.

BACKGROUND

1. Technical Field

The present invention relates to a liquid droplet discharge device.

2. Related Art

Heretofore, known is an ink supply system for supplying ink to a discharge head capable of discharging the ink through an ink supply pipe from an ink tank storing ink. In the case where such an ink supply system is employed, when the ink is not supplied for a long period of time after the ink is supplied to the discharge head, the ingredients contained in the ink remaining in a flow path of the ink supply pipe precipitate in some cases. When the ingredients contained in ink precipitate, ink cannot be stably supplied to the discharge head or poor discharge occurs in some cases when supplying ink to the discharge head again.

Particularly when inorganic pigments (e.g., titanium oxide), metal pigments (e.g., aluminum), and the like are contained as the ingredients of ink, there arises a problem in that these pigments are likely to precipitate due to a difference in a specific gravity from a solvent.

For example, JP-A-2006-272648 discloses an ink supply system in which a subtank for always holding a fixed amount of ink in an ink flow path. JP-A-2006-272648 also discloses providing a stirring ball in the subtank in order to stir ink in the subtank, for example. By providing such a subtank, the precipitation of the ingredients, such as pigments, contained in ink, can be reduced.

However, in the above-described former technique, when the ink supply is started after the ink supply system has stopped for a long period of time, supernatant liquid having a low pigment concentration in the ink flow path is supplied into the subtank, which has resulted in the fact that the concentration of the pigments contained in the liquid has not been sufficiently recovered in the subtank in some cases. Therefore, liquid having a low pigment concentration has been supplied to the head, which has sometimes resulted in a failure of discharging favorable liquid from the head.

SUMMARY

An advantage of some aspects of the invention is to provide a liquid droplet discharge device capable of supplying and discharging favorable liquid.

The invention has been made in order to at least partially solve the above-described objects and can be realized as the following embodiments or application examples.

APPLICATION EXAMPLE 1

According to a first aspect, a liquid droplet discharge device according to the invention has a storage portion which stores liquid, a first supply pipe which is connected to the storage portion and to which the liquid is supplied from the storage portion, a container which is connected to the first supply pipe and to which the liquid is supplied from the first supply pipe, a head which discharges the liquid supplied from the container, and a stirring member which stirs the liquid in the container, in which the capacity of the container is equal to or larger than the capacity of the first supply pipe.

According to the invention of Application Example 1, in the case where precipitable ingredients are contained in liquid, even when the precipitable ingredients precipitate in the first supply pipe and supernatants are supplied to the container, the concentration of the precipitable ingredients contained in liquid can be recovered to the level which causes no problems in practical use in the container because the capacity of the container is equal to or larger than the capacity of the first supply pipe. Thus, liquid in which a reduction in the concentration of the precipitable ingredients is suppressed can be supplied to the head, and thus favorable liquid can be discharged from the head.

APPLICATION EXAMPLE 2

In Application Example 1, the liquid droplet discharge device can further have a carriage on which the container and the head are mounted and reciprocates in a given direction.

According to the invention of Application Example 2, the container moves in a given direction with the reciprocating movement of the carriage, and thus the liquid in the container can be easily stirred.

APPLICATION EXAMPLE 3

In Application Example 1 or 2, the capacity of the container can be 5 times or lower the capacity of the first supply pipe.

According to the invention of Application Example 3, the capacity of the container is 5 times or lower the capacity of the first supply pipe, and thus favorable liquid can be supplied to the head without blocking the movement of the carriage when the container is mounted on the carriage.

APPLICATION EXAMPLE 4

In either one of Application Example 1 or 3, the capacity of the container can be 1.5 times or more and 5 times or lower the capacity of the first supply pipe.

According to the invention of Application Example 4, when the precipitable ingredients in liquid are contained, liquid in which a reduction in the concentration of the precipitable ingredients is further suppressed can be supplied to the liquid, and thus more favorable liquid can be discharged from the head.

APPLICATION EXAMPLE 5

In any one of Application Examples 1 to 4, the liquid can be discharged from the head while stirring the liquid in the container with the stirring member.

According to the invention of Application Example 5, liquid that is sufficiently stirred in the container can be supplied to the head, and thus favorable liquid can be discharged from the head.

APPLICATION EXAMPLE 6

In any one of Application Examples 1 to 5, the liquid droplet discharge device has a second supply pipe which connects the container and the head, and a member which discharges the liquid whose capacity is equal to or larger than the total of the capacity of the second supply pipe and the capacity of the head, in which the capacity of the container can be equal to or larger than the total of the capacity of the second supply pipe and the capacity of the head.

According to the invention of Application Example 6, in the case where the liquid in the container is discharged, when all the liquid in the container is discharged, the inside of the second supply pipe and the inside of the head are occupied with the liquid supplied from the container. In such a case, the liquid in the second supply pipe and the head is sufficiently stirred in the container. Therefore, when the liquid is discharged from the head, the concentration of the ingredients contained in the liquid can be made favorable from the liquid that is first discharged from the head.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, the embodiments of the invention will be described but the invention is not limited thereto.

1. Liquid Droplet Discharge Device

The liquid droplet discharge device according to the invention has a storage portion that stores liquid, a first supply pipe which is connected to the storage portion and to which the liquid is supplied from the storage portion, a container which is connected to the first supply pipe and to which the liquid is supplied from the first supply pipe, a head which discharges the liquid supplied from the container, and a stirring member which stirs the liquid in the container, in which the capacity of the container is equal to or larger than the capacity of the first supply pipe.

Figure 1:
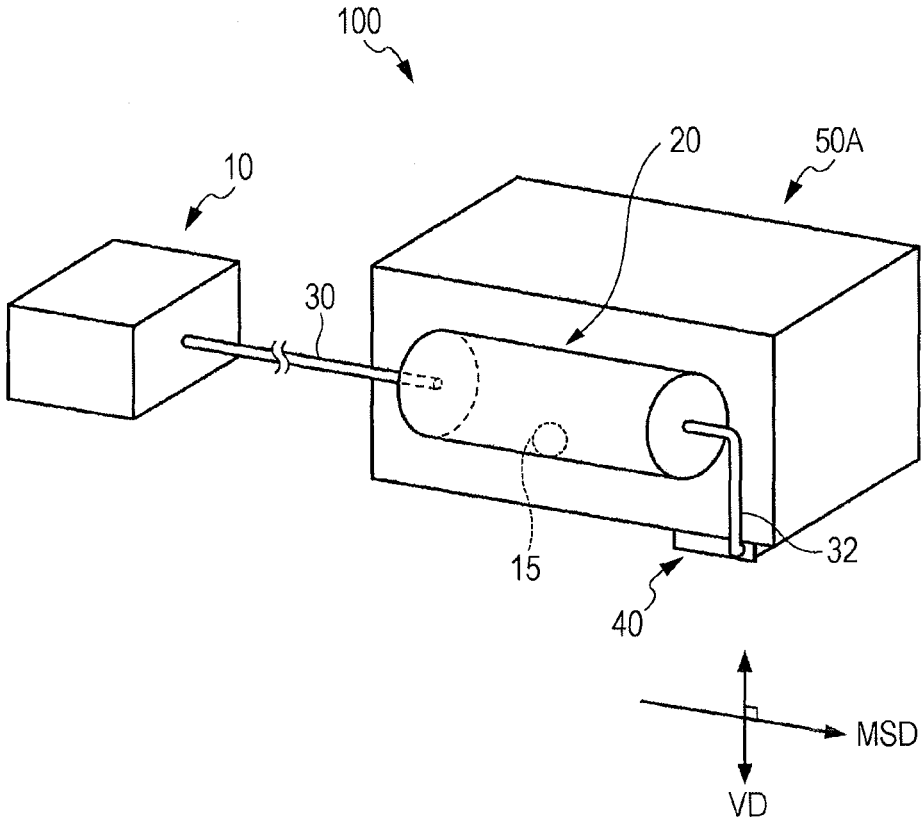
FIG. 1 is a perspective view schematically illustrating a liquid droplet discharge device according to this embodiment.

FIG. 1 is a perspective view schematically illustrating a liquid droplet discharge device 100 according to this embodiment. Hereinafter, the liquid droplet discharge device 100 according to this embodiment will be described with reference to FIG. 1.

1.1. Storage Portion

The liquid droplet discharge device 100 in this embodiment has a storage portion 10. The storage portion 10 stores liquid containing given ingredients. The storage portion 10 illustrated in FIG. 1 is connected to a container 20 through a first supply pipe 30. Thus, liquid can be made to flow into the container 20.

The liquid in the invention can contain precipitable ingredients, and, for example, dispersion, such as suspension and emulsion, can be mentioned. Mentioned as the liquid stored in the storage portion 10 are, for example, ink compositions, organic EL display materials, color filter materials for liquid crystal displays and the like, FED (field emission display) materials, electrodes or color filter materials for electrophoretic displays and the like, biological organic materials for use in manufacturing of biochips, and the like.

In the invention, the "precipitation" refers to the fact that when liquid is left for a given period of time, the ingredients contained in the liquid precipitate, and then the ingredients contained in the liquid accumulate on the lower layer of the liquid. For example, in the case of ingredients having a high specific gravity to a solvent and ink compositions, one substance selected from inorganic pigments, metal pigments, and hollow resin particles can be included or ingredients bonding or adsorbing thereto can be included, for example.

As the inorganic pigments, titanium dioxide, silicon oxide, aluminum oxide, zinc oxide, iron oxide, carbon black, and the like can be mentioned, for example. As the metal pigments, simple substances, such as aluminum, gold, silver, copper, brass, and titanium, or alloys thereof can be mentioned, for example. As the hollow resin particles, hollow resin particle disclosed in U.S. Pat. Nos. 4,880,465 or 3,562,754, can be mentioned, for example. The hollow resin particles have a hollow therein and the outer shell thereof is formed from resin having liquid permeability. The hollow resin particles can be used as a white pigment.

Hereinafter, white ink compositions that are typically used as the liquid stored in the storage portion 10 will be described. In the invention, the "white ink" refers to ink in which the brightness (L*) and the chromaticity (a*, b*) of ink that is discharged to Epson Genuine Glossy Photo Paper (manufactured by Seiko Epson Corporation) at a duty of 100% or more are in the range of $70 \le L^* \le 100$, $-4.5 \le a^* \le 2$, and $-6 \le b^* \le 2.5$ when measured using a spectrophotometer Spectrolino (Trade name, manufactured by GretagMacbeth) under the measurement conditions of D50 light source, the observation view of 2°, the concentration of DIN NB, the white standard of Abs, the filter of No, and the measurement mode of Reflectance.

In this specification, the "duty" is a value calculated by the following equation.

$$\text{duty}(\%) = \text{Number of actually discharged dots}/(\text{Vertical resolution} \times \text{Horizontal resolution}) \times 100$$

In the equation the "Number of actually discharged dots" is the number of actually discharged dots per unit area and the "vertical resolution" and the "horizontal resolution" are the resolution per unit area, respectively.

The white ink composition can contain resin that fixes pigments. Mentioned as the resin are polyvinyl alcohol, polyethylene glycols, polyacrylic acid, polyurethane, polyacrylamide, cellulose derivatives, and the like. When mentioned under the product name, acrylic resin (e.g., Almatex, manufactured by Mitsui Chemical Co., Ltd.), urethane resin (e.g., WBR-022U, manufactured Taisei Fine Chemical), and the like are mentioned.

The white ink composition preferably contains one substance selected from alkanediol and glycol ether. The alkanediol or the glycol ether can improve the wettability of a discharge target medium to a discharge target surface and can increase the permeability of ink.

The alkane diol is preferably 1,2-alkanediol whose number of carbon atoms is 4 or more and 8 or lower, such as 1,2-butanediol, 1,2-pentanediol, 1,2-hexanediol, 1,2-heptanediol, and 1,2-octanediol. Among the above, 1,2-hexanediol, 1,2-heptanediol, and 1,2-octanediol having whose number of carbon atoms is 6 or more and 8 or lower are more preferable because the permeability to a discharge target medium is particularly high.

As the glycol ether, lower alkyl ether of polyhydric alcohol, such as ethylene glycol monomethyl ether, ethylene glycol monoethyl ether, ethylene glycol monobutyl ether, diethylene glycol monomethyl ether, diethylene glycol monoethyl ether, diethylene glycol monobutyl ether, dipropylene glycol monomethyl ether, dipropylene glycol monoethyl ether, triethylene glycol monomethyl ether, triethylene glycol monobutyl ether, and tripropylene glycol monomethyl ether, can be mentioned. Among the above, when triethylene glycol monobutyl ether is used, favorable quality can be obtained.

The white ink composition preferably contains an acetylene glycol surfactant or a polysiloxane surfactant. The acetylene glycol surfactant or the polysiloxane surfactant can increase the wettability of a discharge target medium or the like to a discharge target surface and can increase the permeability of ink.

Mentioned as the acetylene glycol surfactant are, for example, 2,4,7,9-tetramethyl-5-decyne-4,7-diol, 3,6-dimethyl-4-octyne-3,6-diol, 3,5-dimethyl-1-hexyne-3-ol, 2,4-dimethyl-5-hexyne3-ol, and the like. In addition thereto, commercially available items can also be used for the acetylene glycol surfactant and, for example, Olfine E1010, STG, Y (all manufactured by Nissin Chemical Industry Co., Ltd.), Surfinol 104, 82, 465, and 485, and TG (all manufactured by Air Products and Chemicals Inc.).

As the polysiloxane surfactant, commercially available items can be utilized, and, for example, BYK-347, BYK-348 (manufactured by BYK-Chemie Japan K.K.), and the like are mentioned.

The white ink composition can further contain other surfactants, such as anionic surfactants, nonionic surfactants, and amphoteric surfactants.

The white ink composition preferably contains polyhydric alcohol. The polyhydric alcohol can suppress drying of ink to thereby prevent clogging of ink at a discharge head portion when the white ink composition is applied to ink jet recording devices, for example.

Mentioned as the polyhydric alcohol are, for example, ethylene glycol, diethylene glycol, triethylene glycol, polyethylene glycol, polypropylene glycol, propylene glycol, butylene glycol, 1,2,6-hexanetriol, thio glycol, hexylene glycol, glycerin, trimethylol ethane, trimethylolpropane, and the like.

The white ink composition can contain water as a solvent. For water, it is preferable to use pure water or ultrapure water, such as ion exchanged water, ultrafiltration water, reverse osmosis water, and distilled water. In particular, water obtained by sterilizing the water mentioned above by ultraviolet exposure or hydrogen peroxide addition can suppress the generation of mold or bacteria over a long period of time and thus is preferable.

The white ink composition can further contain, as required, additives, such as fixing agents, such as water soluble rosin, antifungal agents and antiseptics, such as sodium benzoate, antioxidants and UV absorbers, such as allophanates, chelating agents, pH adjusters, such as triethanolamine, and oxygen absorbents. These additives can be used alone or in combination of two or more kinds thereof.

Although the white ink, composition is described taking aqueous ink compositions as an example, ultraviolet curable ink and the like may be used. When ultraviolet curable ink is used, photopolymerization initiators and the like can be mentioned, for example, as the precipitable ingredients.

1.2. Supply Pipe

The liquid droplet discharge device 100 in this embodiment has the first supply pipe 30 that connects the storage portion 10 and the container 20. The liquid stored in the storage portion 10 is supplied to the first supply pipe 30.

The inner diameter of the first supply pipe 30 is not particularly limited. When the liquid droplet discharge device 100 has a stirrer 15 as illustrated in FIG. 1, the inner diameter of the first supply pipe 30 may be adjusted to the size in such a manner that the stirrer 15 does not move into the first supply pipe 30. For example, the inner diameter of the first supply pipe 30 is preferably 2 mm or more and 5 mm or lower and more preferably 2 mm or more and 4 mm or lower.

The liquid droplet discharge device 100 in this embodiment can further have a second supply pipe 32 that connects a container 20 and a head 40 as illustrated in FIG. 1. In the example of FIG. 1, the liquid stored in the storage portion 10 is supplied to the container 20 through the first supply pipe 30, stirred by the stirrer 15 in the container 20, and then supplied to the head 40 through the second supply pipe 32. The inner diameter of the second supply pipe 32 is the same as in the first supply pipe 30 and thus the description is omitted.

In the example of FIG. 1, the container 20 and the head 40 are connected through the second supply pipe 32 but the container 20 and the head 40 may be directly connected not through the second supply pipe 32 without being limited to the above-described structure.

1.3. Container and Stirring Member

The liquid droplet discharge device 100 in this embodiment has the container 20 which is connected to the first supply pipe 30 and to which liquid is supplied from the first supply pipe 30. The liquid droplet discharge device 100 of this embodiment further has a stirring member for stirring liquid in the container.

Here, when the liquid droplet discharge device 100 is left for a long period of time, precipitate generates in the first supply pipe 30 in some cases. In such a case, when another liquid is supplied into the first supply pipe 30 from the storage portion 10 to cause the liquid remaining in the first supply pipe 30 to flow out, liquid (supernatant) in which the concentration of the precipitable ingredients decreases or precipitate is directly supplied to the head 40 in some cases. Therefore, the head 40 causes poor discharge or favorable images cannot be recorded on a discharge target medium P in some cases. Such problems can be reduced by providing the container 20 at the liquid outflow side in the first supply pipe 30. Specifically, the container 20 temporarily stores the precipitate or the supernatants in the first supply pipe 30, and can stir the precipitate or the supernatants in the first supply pipe 30 and the liquid in the container 20 by a stirring member. Thus, liquid in which a reduction in the concentration of the precipitable ingredients contained in the liquid is suppressed can be supplied to the head 40.

The stirring member of the container provided in the liquid droplet discharge device in this embodiment is not particularly limited and, for example, one having the following mechanism can be mentioned.

Figure 2:
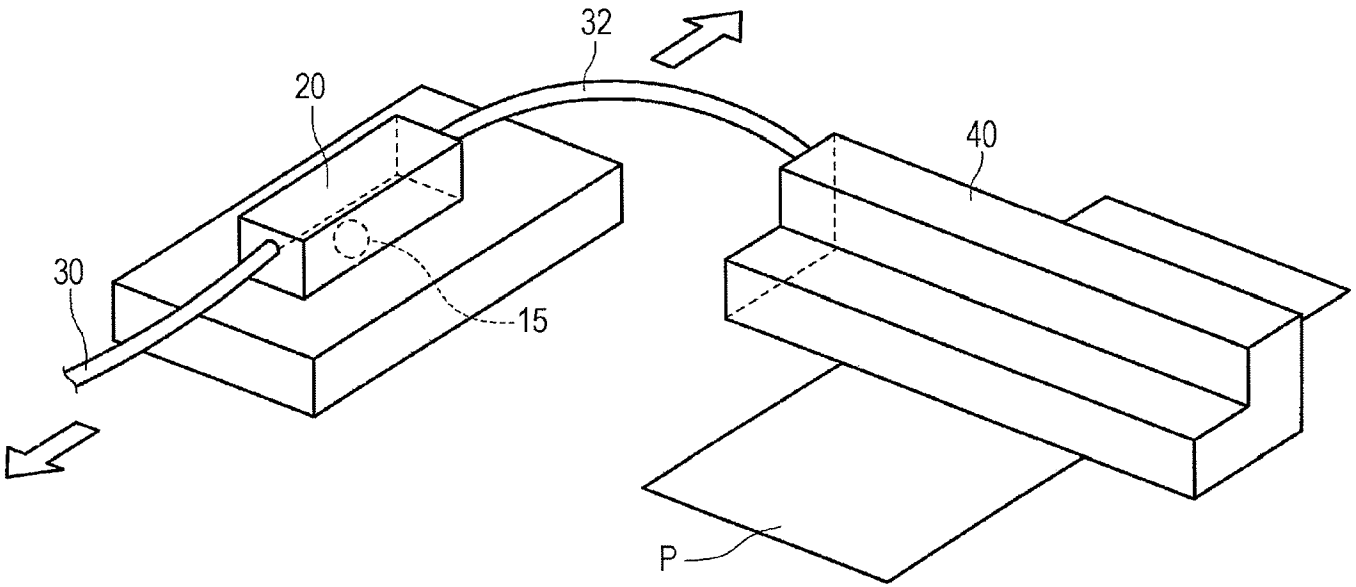
FIG. 2 is a perspective view schematically illustrating a stirring member and a head in the liquid droplet discharge device according to this embodiment.
Figure 3:
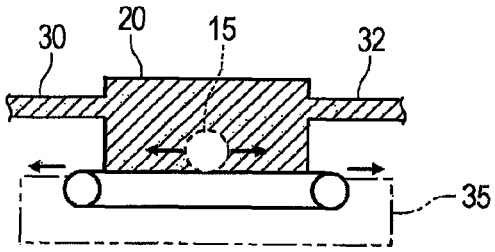
FIG. 3 is a side view schematically illustrating the stirring member in the liquid droplet discharge device according to this embodiment.

For example, the container 20 may be mounted on a carriage having an X·Y movement mechanism (moving on the X-Y plane) disclosed in JP-A-2002-225255. In this case, the container 20 moves with the movement of the carriage, and thus the liquid in the container 20 can be stirred. Moreover, as illustrated in FIG. 2, when the liquid droplet discharge device has a line type head 40, the container 20 may be provided at the side of the line type head 40. In this case, as illustrated in FIG. 3, the stirrer 15 disposed in the container 20 may be moved using a vibrator 35 attached to the container 20 to thereby stir the liquid in the container 20.

Figure 4:
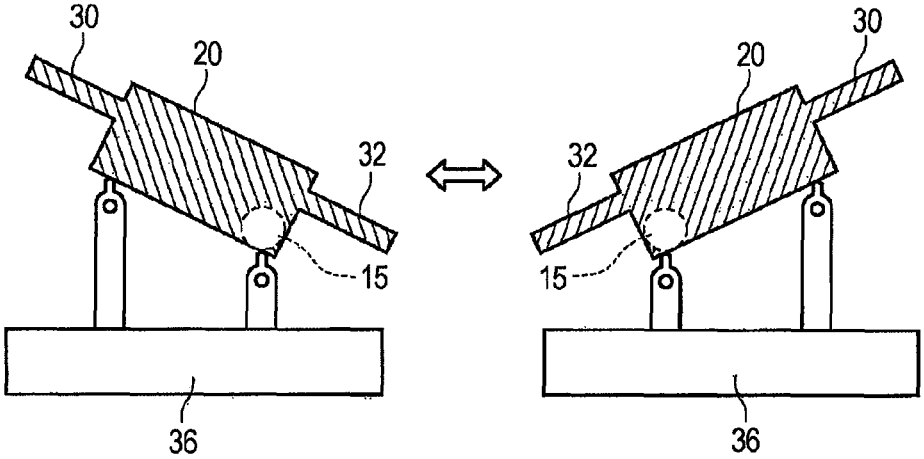
FIG. 4 is a side view schematically illustrating the stirring member in the liquid droplet discharge device according to this embodiment.
Figure 5:
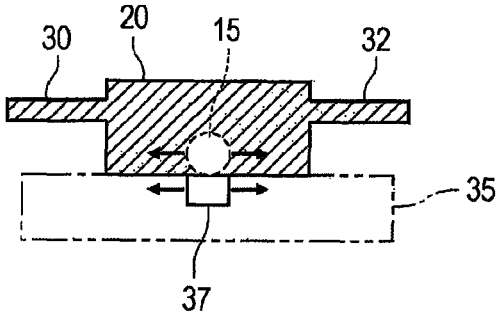
FIG. 5 is a side view schematically illustrating the stirring member in the liquid droplet discharge device according to this embodiment.

Moreover, as illustrated in FIG. 4, the stirrer 15 may be moved in the container 20 using a tilting device 36 that alternately tilts the container 20 to thereby stir the liquid in the container 20. In addition, as illustrated in FIG. 5, a magnet 37 may be moved from the outside of the container 20 to move the stirrer 15 formed with magnetic metal to thereby stir the liquid in the container 20.

Figure 6:
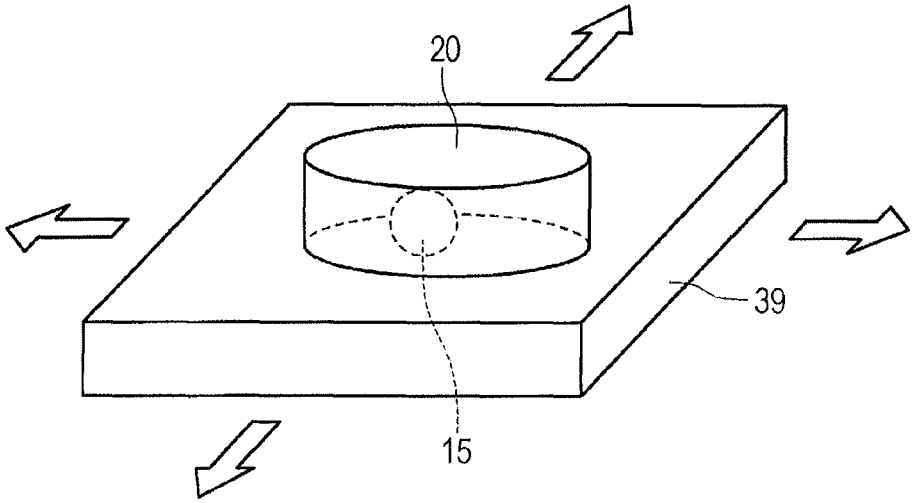
FIG. 6 is a perspective view schematically illustrating the stirring member in the liquid droplet discharge device according to this embodiment.

The stirring member in this embodiment is not limited to one that moves the stirrer in one direction to thereby stir the liquid. For example, as illustrated in FIG. 6, the container 20 may be attached to a movable device 39 that works on the X-Y plane, and the stirrer 15 in the container 20 may be moved in the container 20 by the movable device 39 to thereby stir the liquid in the container 20. In addition, the liquid droplet discharge device can employ known stirring members that move the stirrer 15.

Here, the line type head refers to one in which the head is formed in such a manner as to be larger than the width of a discharge target medium and liquid droplets are discharged to the discharge target medium without the movement of the head to thereby form desired images. When the head provided in the liquid droplet discharge device is a line type head, the installation position of the container is not particularly limited. The second supply pipe is preferably as short as possible because the liquid therein cannot be stirred by the stirrer 15. When the line type head is used as the head, the container and the head are preferably provided side by side.

A serial type head refers to one on which a carriage that can move in a given direction is mounted and which forms desired images on a discharge target medium by the movement of the head with the movement of the carriage. When the head provided on the liquid droplet discharge device is the serial type head, the installation position of the container is not particularly limited and the container can be mounted on the carriage, for example.

When the liquid droplet discharge device has the serial type head, a mechanism in which the container is mounted on the carriage, and then the container is moved with the movement of the carriage in a given direction to thereby stir the liquid in the container is mentioned as a stirring member other than the above-described stirring member. Thus, when the container is mounted on the carriage, it is not necessary to separately provide the mechanism for stirring the liquid in the container and the liquid in the container can be stirred using the movement mechanism of the carriage. Therefore, the structure is excellent from the viewpoint that when the container is mounted on the carriage, a liquid droplet discharge device excellent in stirring efficiency can be easily obtained. When the stirring member in which the container is mounted on the carriage is used, it is preferable to dispose a stirrer beforehand in the container. Thus, the stirrer in the container moves with the movement of the carriage, and thus the stirring efficiency of the liquid in the container can be increased.

FIG. 1 illustrates the liquid droplet discharge device 100 having a serial type head. Specifically, in the liquid droplet discharge device 100 in FIG. 1, the container 20 is mounted on a carriage 50A and the stirrer 15 is disposed in the container 20 as a stirring member for the liquid in the container 20. The container 20 is connected to the storage portion 10 through the first supply pipe 30 and is connected to the head 40 through the second supply pipe 32.

The shape of the container 20 of the liquid droplet discharge device 100 according to this embodiment is a cylindrical shape in the example of FIG. 1 but is not limited thereto and may be a rectangular parallelepiped shape, an elliptic cylindrical shape, or the like, for example.

The capacity of the container 20 is equal to or larger than the capacity of the first supply pipe 30, and is preferably 1 times or more and 5 times or lower the capacity of the first supply pipe 30 and more preferably 1.5 times or more and 5 times or lower the capacity of the first supply pipe 30. In the case where the capacity of the container 20 is equal to or larger than the capacity of the first supply pipe 30, even when liquid (supernatant) in which the concentration of the precipitable ingredients in the first supply pipe 30 is reduced is supplied to the container 20, the concentration of the precipitable ingredients contained in the liquid can be recovered to the level which causes no problems in practical use in the container 20. Thus, liquid in which a reduction in the concentration of the precipitable ingredients is suppressed can be supplied to the head 40, and thus favorable liquid can be discharged from the head 40. Specifically, when the supply of the supernatants in the first supply pipe 30 to the container 20 is started after the liquid droplet discharge device 100 is left for a long period of time, the concentration of the precipitable ingredients in the container 20 continuously decreases until all the supernatants in the first supply pipe 30 are supplied into the container 20. In such a case, even when the capacity of the container 20 is equal to or larger than the capacity of the first supply pipe 30, the concentration of the precipitable ingredients in the container 20 decreases but the reduction ratio can be lowered. Thus, liquid in which a reduction in the concentration of the precipitable ingredients is suppressed can be supplied to the head 40.

In contrast, when the capacity of the container 20 is lower than the capacity of the first supply pipe 30, the concentration of the precipitable ingredients contained in the liquid to be supplied to the head 40 sharply decreases, and thus favorable liquid cannot be discharged from the head 40 in some cases. When the capacity of the container 20 exceeds 5 times the capacity of the first supply pipe 30 when the container 20 is mounted on the carriage 50A, the amount of liquid stored in the container 20 increases, and thus the carriage 50A becomes hard to move. In the invention, the capacity of the container 20 refers to the volume in the container 20 and the capacity of the first supply pipe 30 refers to the volume in the first supply pipe 30. The capacity of the second supply pipe 32 refers to the volume in the second supply pipe 32. The capacity of the head 40 refers to the volume of a portion which is charged with liquid in the head 40.

1.4. Head

The liquid droplet discharge device 100 according to this embodiment is connected to the container 20 and has the head 40 that discharges liquid supplied from the container 20. The head 40 may have two or more nozzle openings and can discharge liquid from the nozzle openings. The head 40 of the liquid droplet discharge device 100 according to this embodiment may be the line type head or the serial type head described above. In the example of FIG. 1, the head 40 is the serial type head, mounted on the carriage 50A, and connected to the container 20 through the second supply pipe 32. The head 40 can discharge liquid supplied from the second supply pipe 32.

The liquid supplied to the head 40 is one which is stirred in the container 20 and in which a reduction in the concentration of the precipitable ingredients is suppressed. Thus, the head 40 can discharge liquid in which a reduction in the concentration of the precipitable ingredients is suppressed.

1.5. Carrying Mechanism

The liquid droplet discharge device according to this embodiment can have a carrying mechanism (not illustrated)

for carrying a discharge target medium (not illustrated). The carrying mechanism moves a discharge target medium to the position where liquid discharged from the head can be made to land. Thus, desired images can be formed on the discharge target medium. The carrying mechanism is not particularly limited insofar as the mechanism has a mechanism for moving a discharge target medium and, for example, may be constituted by a roller, a motor, and the like. In this case, the roller is rotated by the driving force of the motor, so that a discharge target medium can be moved by the rotation of the roller. The position where the carrying mechanism is provided is not particularly limited and the carrying mechanism can be provided at the position facing the discharge surface of the head 40, for example.

The discharge target medium is not particularly limited. For example, mentioned are regular paper, mat paper, coated paper, glass, a plastic film, such as vinyl chloride, a film having a base material coated with plastic or a receiving layer, and the like, for example.

1.6. Carriage

The liquid droplet discharge device according to this embodiment can have a carriage that moves in a given direction. In FIG. 1, the carriage 50A can reciprocate in the main scanning direction MSD by the power of a carriage motor (not illustrated) serving as the drive source, for example. When the container 20 is mounted on the carriage 50A and has the stirrer 15 in the container 20, the stirrer 15 in container 20 mounted on the carriage 50A moves by the movement of the carriage 50A. Therefore, liquid in the container 20 can be more efficiently stirred. When the head is a serial type head mounted on the carriage, liquid can be discharged from the head 40 with the movement of the carriage 50A, and therefore the liquid can be discharged to a desired position.

1.7. Discharge Member

The liquid droplet discharge device according to this embodiment can have a suction member equivalent to a discharge member for discharging liquid in the container 20 from the head 40. As the suction member, a vacuum pump, a tube pump, and the like can be mentioned, for example. For the suction of the liquid with a tube pump, the mechanism illustrated in FIG. 13 of JP-A-2003-165231 can be used, for example.

In the liquid droplet discharge device 100 in this embodiment, when liquid is sucked from the head 40, the liquid in the container 20 is discharged from the head 40 and also the liquid in the first supply pipe 30 is supplied into the container 20, and also the liquid in the container 20 is supplied into the second supply pipe 32. Thus, the concentration of the ingredients contained in the liquid in the second supply pipe 32 can be kept at a favorable concentration before the liquid discharge operation (discharge operation) from the head 40 to a discharge target medium.

The discharge member for discharging the liquid in the container 20 is not limited to the above-described pump (suction member) for sucking. For example, a member (flushing) for discharging liquid from the head 40 to a liquid absorption pad, and performing maintenance of the nozzle openings of the head 40, which has been performed heretofore, may be acceptable. In addition, a member for discharging liquid from the head 40 without discharging liquid to a discharge target medium may be acceptable.

It is preferable for the capacity in the container 20 to satisfy the above-described relationship with the capacity of the first supply pipe 30 and to be equal to or larger than total of the capacity of the second supply pipe 32 and the capacity of the head 40. In the case where such a relationship is satisfied, when all the liquid in the container 20 is discharged in the case of discharging the liquid in the container 20, the inside of the second supply pipe 32 and the inside of the head 40 are occupied with the liquid supplied from the container 20. In such a case, the liquid in the second supply pipe 32 and head 40 is sufficiently stirred in the container. Therefore, when liquid is discharged from the head, the concentration of the ingredients contained in the liquid can be made favorable from the liquid that is first discharged from the head.

1.8. Effects

In the liquid droplet discharge device 100 according to this embodiment, the capacity of the container 20 is equal to or larger than the capacity of the first supply pipe 30, and thus the concentration of precipitable ingredients contained in liquid can be recovered to the level which causes no problems in practical use in the container 20. Thus, liquid in which a reduction in the concentration of the precipitable ingredients is suppressed can be supplied to the head 40, and favorable liquid can be discharged from the head 40.

2. Ink Jet Printer

The liquid droplet discharge device according to the invention can be applied to an ink jet printer. This embodiment describes an ink jet printer 300 having a serial type head to which the liquid droplet discharge device 100 is applied. Although an example in which the liquid droplet discharge device according to the invention is applied to an ink jet printer having a serial type head is described but the invention is not limited thereto. The ink jet printer according to the invention may be applied to an ink jet printer having a line type head, for example.

Figure 7:
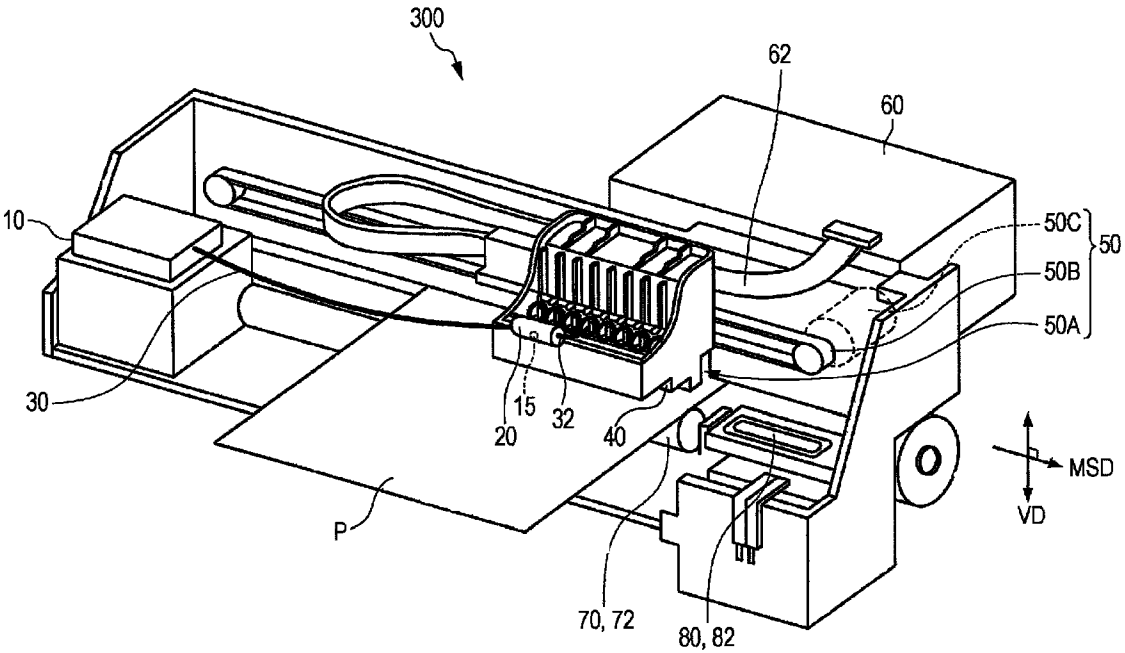
FIG. 7 is a perspective view schematically illustrating an ink jet printer according to this embodiment.

FIG. 7 is a perspective view schematically illustrating an ink jet printer 300 containing the liquid droplet discharge device 100. The ink jet printer 300 according to this embodiment can have a control portion 60, a storage portion 10, a first supply pipe 30, a second supply pipe 32, an actuator 50, a paper feed portion 70, and a suction portion 80 as illustrated in FIG. 7.

The storage portion 10, the first supply pipe 30, the second supply pipe 32, and the liquid stored in the storage portion 10 are described in "1. Liquid Droplet Discharge Device" above, and thus the description therefor is omitted.

The control portion 60 can be constituted using a computer with a CPU and a memory. The control portion 60 has a function of controlling the storage portion 10, the actuator 50, the paper feed portion 70, and the suction portion 80.

The actuator 50 can have a carriage 50A, a drive belt 50B, and a carriage motor 50C. The actuator 50 is connected to the control portion 60 through a flexible cable 62 and is controlled by the control portion 60.

The actuator 50 has a function of reciprocating the carriage 50A in a given direction MSD. Specifically, the drive belt 50B connected to the carriage 50A is driven by the power of the carriage motor 50C serving as the drive source of the carriage 50A to thereby reciprocate the carriage 50A in the given direction MSD.

As described in "1. Liquid Droplet Discharge Device" above, the container 20 and the head 40 are mounted on the carriage 50A. When the carriage 50A is moved in the given direction MSD, liquid droplets are discharged from the head 40 as appropriate to thereby perform recording on the recording form P.

The head 40 can have two or more nozzles that discharges liquid droplets. A method for discharging liquid droplets of the head 40 is not particularly limited, and an ink jet discharge method can be utilized, for example. As an ink jet discharge method, all the known former methods can be used and a piezo ink jet method, a thermal jet ink jet method, and the like can be mentioned, for example.

The paper feed portion 70 has a paper feed motor (not illustrated) serving as the drive source and a paper feed roller 72 that rotates by the operation of the supply motor. The paper feed portion 70 can carry a recording paper P in a direction crossing the given MSD direction. The paper feed portion 70 is equivalent to the carrying mechanism described in "1. Liquid Droplet Discharge Device" above.

The suction portion 80 may have the same structure as the discharge member described in "1. Liquid Droplet Discharge Device" above and may be shared with the discharge member described in "1. Liquid Droplet Discharge Device" above. Specifically, as illustrated in FIG. 7, the suction portion 80 can have a cap device 82 and a tube pump (not illustrated). The suction portion 80 can discharge the liquid in the container 20 through the head 40 by connecting the cap device 82 to the head 40, sealing the liquid discharge surface of the head 40, and then discharging the air in a tube (not illustrated) with a pump roller (not illustrated) connected to the cap device 82. Thus, clogging of the nozzle openings or the like of the head 40 can be prevented. The suction portion 80 can be used not only for preventing clogging of the nozzle openings of the head 40 but for sucking precipitate or liquid in the first supply pipe 30 or the second supply pipe 32, for example. The suction method is not limited to the above-described method using a pump roller, and known methods can be used.

The ink jet printer 300 according to this embodiment has the liquid droplet discharge device 100 described above, and thus liquid in which a reduction in the concentration of precipitable ingredients is suppressed can be supplied to the head 40 and favorable liquid can be discharged from the head 40.

In the invention, the case where the liquid droplet discharge device 100 is applied to an image recorder, such as the ink jet printer 300, is described but the invention is not limited thereto. For example, the liquid droplet discharge device 100 can also be applied to a color material ejecting device for use in the manufacturing of color filters of liquid crystal displays and the like, a liquid material ejecting device for use in the formation of electrodes or color filters of an organic EL display, an FED (field emission display), and an electrophoretic display, and the like.

3. EXAMPLES

Hereinafter, the invention will be more specifically described with reference to Examples but is not limited thereto.

3.1. Preparation of White Ink Composition

White ink compositions A to D having the following composition were prepared. The average particle diameter of titanium dioxide contained in each white ink composition represents the volume average diameter (Mv) and is measured using a nano track particle size distribution meter UPA-EX150 (product name, manufactured by Nikkiso Co., Ltd.) employing a dynamic light scattering method as the measurement principle. The volume average diameter (Mv) refers to the average diameter weighted by volume and is calculated by the following equation based on the volume and the measured diameter value of each particle.

$$\text{Volume average diameter } (Mv)=\Sigma(Vi-di)/\Sigma(Vi)$$

In the equation, Vi represents the volume (i=1, 2, . . . , N) of the particles i and di represents the diameter (i=1, 2, . . . , N) of the particles i.

(1) White Ink Composition A
Titanium dioxide (Average particle diameter of 440 nm, Specific gravity of 4.3): 10.0% by mass
Styrene-acrylic acid copolymer: 2.0% by mass
1,2-hexanediol: 5.0% by mass
Glycerin: 10.0% by mass
Triethanolamine: 0.9% by mass
BYK-348 (BYK-Chemie Japan K.K.): 0.5% by mass
Ultrapure water: Balance
Total: 100% by mass (2) White Ink Composition B
Titanium dioxide (Average particle diameter of 440 nm, Specific gravity of 4.3): 5.0% by mass
Styrene-acrylic acid copolymer: 2.0% by mass
1,2-hexanediol: 5.0% by mass
Glycerin: 10.0% by mass
Triethanolamine: 0.9% by mass
BYK-348 (BYK-Chemie Japan K.K.): 0.5% by mass
Ultrapure water: Balance
Total: 100% by mass (3) White Ink Composition C
Titanium dioxide (Average particle diameter of 440 nm, Specific gravity of 4.3): 3.0% by mass
Styrene-acrylic acid copolymer: 2.0% by mass
1,2-hexanediol: 5.0% by mass
Glycerin: 10.0% by mass
Triethanolamine: 0.9% by mass
BYK-348 (BYK-Chemie Japan K.K.): 0.5% by mass
Ultrapure water: Balance
Total: 100% by mass (4) White Ink Composition D
Titanium dioxide (Average particle diameter of 440 nm, Specific gravity of 4.3): 2.8% by mass
Styrene-acrylic acid copolymer: 2.0% by mass
1,2-hexanediol: 5.0% by mass
Glycerin: 10.0% by mass
Triethanolamine: 0.9% by mass
BYK-348 (BYK-Chemie Japan K.K.): 0.5% by mass
Ultrapure water: Balance
Total: 100% by mass

3.2. Allowable Reduction Ratio of Titanium Dioxide Concentration

When images are recorded using ink compositions containing a given concentration of precipitable ingredients, the reduction ratio in the concentration of the precipitable ingredients in the ink compositions that allows recording of favorable images was investigated. Specifically, the following experiment was performed to thereby determine the allowable range of the reduction in the concentration of the precipitable ingredients.

First, the white ink composition A was charged in an ink chamber of a cartridge for use only in an ink jet printer (manufactured by Seiko Epson Corporation incorporated company, Trade name: "PX-G930"). Then, an ink cartridge was loaded on a printer, and a solid pattern image was recorded to a discharge target medium ("OHP sheet" manufactured by Kokuyo Co., Ltd.). The recording was performed at a resolution of 1440×1440 dpi and at a duty of 100%. Thus, an evaluation standard A was obtained.

Next, in order to determine the allowable reduction ratio of the titanium dioxide concentration, solid pattern images were formed for every white ink composition using the white ink compositions B to D in the same manner as in a method for producing the evaluation standard sample A, and then samples B to D for confirming the allowable reduction ratio were obtained.

The evaluation standard A and the samples B to D obtained as described above were measured for the color with a spectrophotometer (Product name: Spectrolino, manufactured by GretagMacbeth) to thereby measure the L* value (degree of whiteness). In the color measurement, a black paper was placed under the evaluation sample. The black paper is obtained by recording a black solid image on a photo paper (Product name: CRISPIA, manufactured by Seiko Epson Corporation) using an ink jet printer (Product name: PM-A700, manufactured by Seiko Epson Corporation). A higher L* indicates that the degree of whiteness is more excellent. The L* value measured as described above was 75 in the evaluation standard A, 71 in the sample B, 67 in the sample C, and 64 in the sample D.

The evaluation standard A and the samples B to D were visually compared. As a result, differences were hardly observed between the sample B and the evaluation standard A. In the sample C, a reduction in the degree of whiteness was observed as compared with the evaluation standard A but the reduction did not cause problems in practical use. In contrast, in the sample D, a reduction in the degree of whiteness was notably observed as compared with the evaluation standard A and thus the sample D was difficult to practically use.

The above-described results show that even when the concentration of the titanium dioxide contained in the white ink compositions decreased to 3.0%, practically usable images can be recorded.

3.3. Production of Titanium Dioxide Concentration Evaluation Sample

For the production of a titanium dioxide concentration evaluation sample, the container 20 described above was mounted on a carriage of an ink jet printer (Product name "EPSON PX-G930", manufactured by Seiko Epson Corporation), and the container 20 was connected to the head through the second feed pipe 32. The container 20 was attached so that the longitudinal direction was parallel to the movement direction (horizontal direction) of the carriage. The inside of the container 20, the inside of the head, and the inside of the second supply pipe 32 were filled with the white ink composition A prepared in "4.1. Preparation of White Ink Composition" above.

For the container 20, a cylindrical one was used and for the stirrer 15 disposed in the container 20, a spherical one was used. The total of the capacity in the head and the capacity in the second supply pipe 32 was 3 ml.

(1) Example 1

3 ml of liquid in the second supply pipe 32 and the head was removed by flushing operation. Next, the supply of an aqueous solution containing 40% by mass of glycerin (hereinafter also referred to as an "aqueous glycerin solution") into the container 20 was started and, simultaneously therewith, the liquid was discharged from the head while reciprocating the carriage in a given direction. In the process, a 1 ml portion of the discharged liquid was stored in a sample bottle, and evaluation samples according to Example 1 were obtained. The capacity of the container 20 used in Example 1 was 5 ml.

Here, the supply of the aqueous glycerin solution to the container 20 was performed supposing the case where, when the liquid droplet discharge device has the first supply pipe, the precipitable ingredients contained in the liquid in the first supply pipe exceedingly precipitate and only the supernatants are supplied to the container 20.

(2) Example 2

An evaluation sample according to Example 2 was obtained in the same manner as in Example 1, except that the capacity of the container 20 was changed to 10 ml.

(3) Example 3

An evaluation sample according to Example 3 was obtained in the same manner as in Example 1, except that the capacity of the container 20 was changed to 15 ml.

(4) Example 4

An evaluation sample according to Example 4 was obtained in the same manner as in Example 1, except that the capacity of the container 20 was changed to 20 ml.

(5) Example 5

An evaluation sample according to Example 5 was obtained in the same manner as in Example 1, except that the capacity of the container 20 was changed to 30 ml.

(6) Example 6

An evaluation sample according to Example 6 was obtained in the same manner as in Example 1, except that the capacity of the container 20 was changed to 40 ml.

(7) Example 7

An evaluation sample according to Example 7 was obtained in the same manner as in Example 1, except that the capacity of the container 20 was changed to 50 ml.

3.4. Evaluation Test of Titanium Dioxide Concentration Evaluation Sample

The concentration of the titanium dioxide in the liquid of the evaluation samples of Examples 1 to 7 was measured using a spectrum photometer (manufactured by Hitachi, Ltd., Product name: "U-3300").

3.5. Evaluation Results

Figure 8:
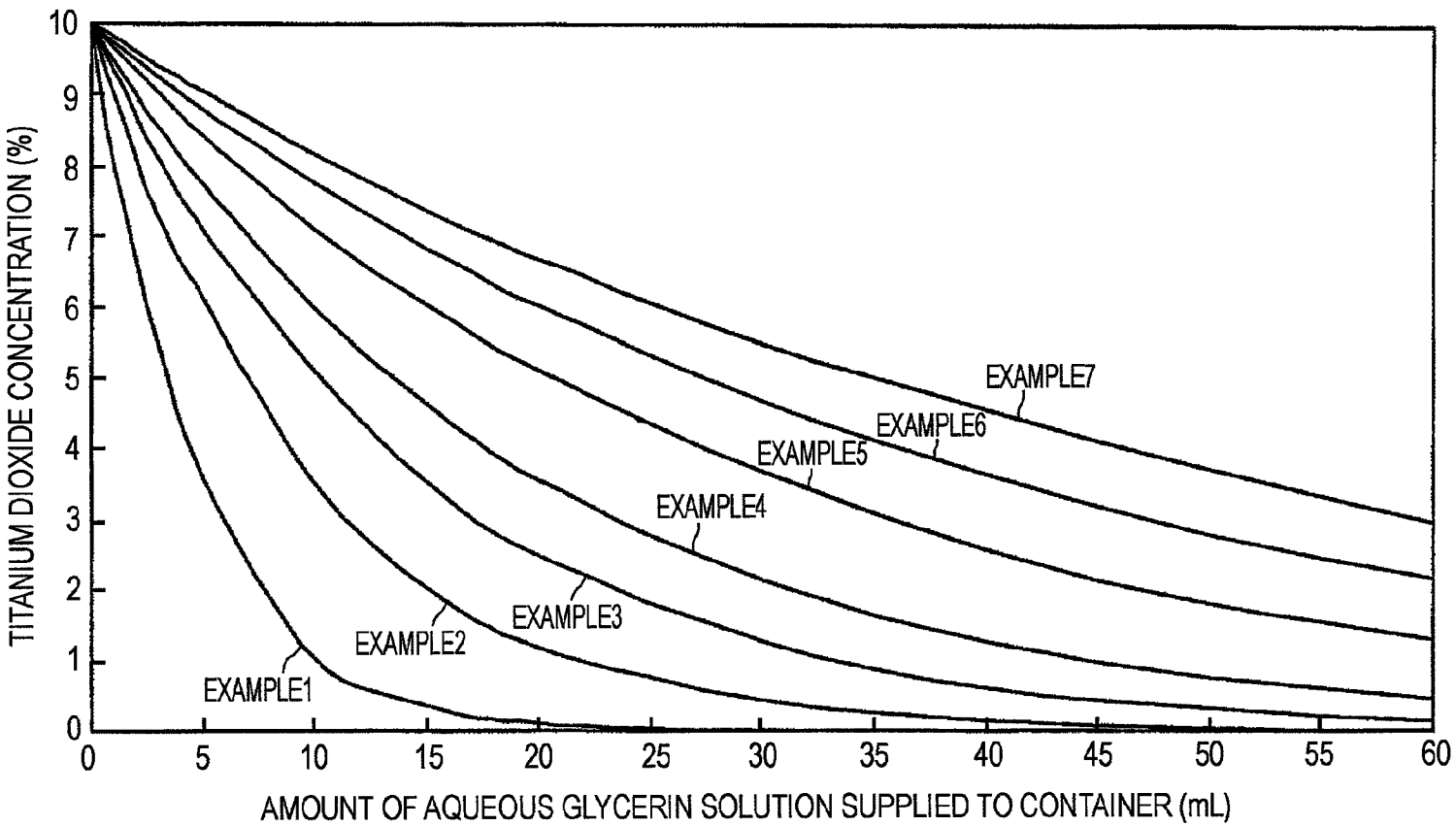
FIG. 8 is view illustrating the concentration of titanium dioxide discharged from a head when liquid is supplied to containers of various capacities.

The evaluation results of the test above are shown in FIG. 8.

As illustrated in FIG. 8, it was confirmed that when the capacity of the container is 1.0 times or more the amount (equivalent to the capacity of the first supply pipe) of the aqueous glycerin solution supplied to the container, the concentration of the titanium dioxide of the collected liquid was 3.0% or more irrespective of the type of the container. This showed that when the capacity of the container is equal to or larger than the capacity of the first supply pipe, images causing no problems in practical use can be recorded. The concentration of the titanium dioxide of the collected liquid when the aqueous glycerin solution whose amount was 1.0 times the capacity of each container is shown in Table 1.

TABLE 1

| | Capacity of container (ml) | Supply amount of aqueous glycerin solution (ml) | Concentration of titanium dioxide (%) |
|---|---|---|---|
| Example. 1 | 5 | 5.0 | 3.28 |
| Example. 2 | 10 | 10.0 | 3.49 |
| Example. 3 | 15 | 15.0 | 3.55 |
| Example. 4 | 20 | 20.0 | 3.58 |
| Example. 5 | 30 | 30.0 | 3.61 |
| Example. 6 | 40 | 40.0 | 3.63 |
| Example. 7 | 50 | 50.0 | 3.64 |

It was also confirmed that when the capacity of the container is 1.5 times or more the amount (equivalent to the capacity of the first supply pipe) of the aqueous glycerin solution supplied to the container, the concentration of the titanium dioxide of the collected liquid was 5.0% or more irrespective of the type of the container. This showed that when the capacity of the container is 1.5 times or more the capacity of the first supply pipe, favorable images can be recorded. The concentration of the titanium dioxide of the collected liquid when the aqueous glycerin solution whose amount was ⅔ times the capacity of each container is shown in Table 2.

TABLE 2

| | Capacity of container (ml) | Supply amount of aqueous glycerin solution (ml) | Concentration of titanium dioxide (%) |
|---|---|---|---|
| Example. 1 | 5 | 3.4 | 5.03 |
| Example. 2 | 10 | 6.7 | 5.10 |
| Example. 3 | 15 | 10.0 | 5.11 |
| Example. 4 | 20 | 13.4 | 5.12 |
| Example. 5 | 30 | 20.0 | 5.12 |
| Example. 6 | 40 | 26.7 | 5.10 |
| Example. 7 | 50 | 34.0 | 5.12 |

The invention is not limited to the embodiments described above and can be modified in various manners. For example, the invention includes substantially the same structure (e.g., the structure with the same functions, methods, and results or the structure with the same objects and effects) as the structure described in the embodiments. The invention also includes a structure in which non-essential portions of the structures described in the embodiments are replaced. The invention also includes a structure that can demonstrate the same effects or a structure that can achieve the same objects as those in the structures described with the embodiments. The invention also includes a structure in which known techniques are added to the structures described in the embodiments.

What is claimed is:

1. A liquid droplet discharge device comprising:

a storage portion which stores liquid;

a first supply pipe which is connected to the storage portion and to which the liquid is supplied from the storage portion;

a container which is connected to the first supply pipe and to which the liquid is supplied from the first supply pipe;

a head which discharges the liquid supplied from the container;

a stirring member which stirs the liquid in the container, a capacity of the container being equal to or larger than a capacity of the first supply pipe;

a second supply pipe which connects the container and the head; and a member which discharges the liquid, a capacity of the member being equal to or larger than a total of the capacity of the second supply pipe and a capacity of the head, wherein the capacity of the container is equal to or larger than the total of the capacity of the second supply pipe and the capacity of the head, wherein, after liquid in the storage portion is supplied into the first supply pipe and the liquid in the first supply pipe is supplied into the container, the stirring member is operable to stir the liquid in the container, and wherein, before the liquid is discharged from the head to a discharge target medium, the device is operable to discharge the liquid in the second supply pipe and the head, and to supply the liquid which is stirred in the container to the second supply pipe and the head.

2. The liquid droplet discharge device according to claim 1, further comprising a carriage on which the container and the head are mounted and which reciprocates in a given direction.

3. The liquid droplet discharge device according to claim 1, wherein the capacity of the container is 5 times or lower the capacity of the first supply pipe.

4. The liquid droplet discharge device according to claim 1, wherein the capacity of the container is 1.5 times or more and 5 times or lower the capacity of the first supply pipe.

5. The liquid droplet discharge device according to claim 1, wherein the liquid is discharged from the head while stirring the liquid in the container with the stirring member.

* * * * *